US011753967B2

(12) United States Patent
Heeter et al.

(10) Patent No.: US 11,753,967 B2
(45) Date of Patent: Sep. 12, 2023

(54) FAN CASE ASSEMBLY FOR A GAS TURBINE ENGINE

(71) Applicant: ROLLS-ROYCE DEUTSCHLAND LTD & CO KG, Blankenfelde-Mahlow (DE)

(72) Inventors: Robert W. Heeter, Noblesville, IN (US); Benedict M. Hodgson, Indianapolis, IN (US); Eric W. Engebretsen, Zionsville, IN (US); Daniel E. Molnar, Lebanon, IN (US)

(73) Assignee: ROLLS-ROYCE DEUTSCHLAND LTD & CO KG, Blankenfel de-Mahlow (DE)

( * ) Notice: Subject to any disclaimer, the term of this patent is extended or adjusted under 35 U.S.C. 154(b) by 0 days.

(21) Appl. No.: 17/721,807

(22) Filed: Apr. 15, 2022

(65) Prior Publication Data

US 2023/0193783 A1 Jun. 22, 2023

Related U.S. Application Data

(60) Provisional application No. 63/292,192, filed on Dec. 21, 2021.

(51) Int. Cl.

| | |
|---|---|
| ***F01D 25/24*** | (2006.01) |
| ***F01D 25/28*** | (2006.01) |
| ***F01D 11/08*** | (2006.01) |

(52) U.S. Cl.

CPC ..... *F01D 25/243* (2013.01); *F01D 11/08* (2013.01); *F01D 25/28* (2013.01);
(Continued)

(58) Field of Classification Search

CPC ..... F01D 25/243; F01D 25/28; F01D 11/08; F05D 2220/36; F05D 2230/60;
(Continued)

(56) References Cited

U.S. PATENT DOCUMENTS 4,149,824 A * 4/1979 Adamson ..... F01D 21/006 415/197
5,267,828 A * 12/1993 Lenhart ..... F16B 5/0208 415/196

(Continued)

FOREIGN PATENT DOCUMENTS

EP 2570620 A1 * 3/2013 ..... F01D 25/145
FR 2997725 A1 * 5/2014 ..... F01D 25/246
FR 3108680 A1 * 10/2021 ..... B64D 27/16

OTHER PUBLICATIONS

3M Mushroom Hook Fasteners, Oct. 16, 2021, retrieved from https://web.archive.org/web/20211016104455mp_/https://www.3m.com/3M/en_US/p/c/tapes/reclosable-fasteners/mushroom-hook/ (Year: 2021).*

(Continued)

*Primary Examiner* — J. Todd Newton
*Assistant Examiner* — Wayne A Lambert
(74) *Attorney, Agent, or Firm* — SHUTTLEWORTH & INGERSOLL, PLC; Timothy Klima

(57) ABSTRACT

Aspects of the disclosure regard a fan case assembly for a gas turbine engine, the fan case assembly comprising a fan case having an inner surface, a fan case liner having an outer surface, and a reclosable fastening system attaching the fan case liner to the fan case, the reclosable fastening system comprising two components, a first component being attached to the fan case inner surface and a second component being attached to the fan case liner outer surface.

19 Claims, 6 Drawing Sheets

(52) U.S. Cl.
CPC ..... *F05D 2220/36* (2013.01); *F05D 2230/60* (2013.01); *F05D 2240/14* (2013.01); *F05D 2260/31* (2013.01); *F05D 2260/96* (2013.01)

(58) Field of Classification Search
CPC ..... F05D 2240/14; F05D 2260/31; F05D 2260/96; F04D 19/002; F04D 29/526; F04D 29/644
See application file for complete search history.

(56) References Cited

U.S. PATENT DOCUMENTS 6,340,286 B1 * 1/2002 Aksit ..... F01D 11/122 415/174.4
9,695,712 B2 * 7/2017 Otsu ..... F01D 25/28
9,797,269 B2 * 10/2017 Evans ..... F01D 25/243
9,810,096 B2 * 11/2017 Evans ..... F02K 3/06
9,828,876 B2 * 11/2017 Kappes ..... F01D 21/045
9,835,046 B2 * 12/2017 Reed ..... F01D 21/045
10,001,136 B2 * 6/2018 Hayton ..... F02C 7/20
10,337,350 B2 * 7/2019 Thomas ..... F01D 21/045
2012/0134774 A1 * 5/2012 Clark ..... B65D 51/14 415/9
2014/0255152 A1 * 9/2014 Totten ..... F01D 21/045 415/9
2015/0003960 A1 * 1/2015 Totten ..... F01D 21/045 415/9
2015/0139779 A1 * 5/2015 Harper ..... F01D 11/122 415/9
2016/0146050 A1 * 5/2016 Molnar ..... F01D 25/24 415/213.1
2016/0201505 A1 * 7/2016 Clarkson ..... F02C 7/20 415/200
2017/0335862 A1 * 11/2017 Heeter ..... F01D 21/045
2020/0200038 A1 * 6/2020 Hall ..... F01D 25/243

OTHER PUBLICATIONS

Plante FR2997725 English Machine Translation, Translated on Nov. 21, 2022 by Espacenet (Year: 2014).*
Bourolleau FR3108680 English Machine Translation, Translated on Nov. 21, 2022 by Espacenet (Year: 2021).*

* cited by examiner

FAN CASE ASSEMBLY FOR A GAS TURBINE ENGINE

This application claims priority to U.S. Provisional Patent Application 63/292,192 filed Dec. 21, 2021, the entirety of which is incorporated by reference herein.

The present disclosure relates to a fan case assembly for a gas turbine engine.

Turbofan gas turbine engines comprise a generally cylindrical fan case which encloses a fan driven by a core engine of the gas turbine engine. It is known to provide a fan case with fan case liners. Within a limited axial extent, fan case liners provide an abradable surface for the fan rotor as well as survive ice shed from the fan rotor blades, and also attenuate noise and improve flutter margin with acoustic treatment.

Fan case liners are attached into a fan case by bonding or bolting or a combination of bonding and bolting. Since bolt holes cannot generally be placed through the main impact region of the fan case, there is a long unsupported distance that a bolted liner has to span across between a front connection and a row of attachment bolts. However, it is challenging to have a bolted-only liner across a medium-sized fan rotor with its resonant modes above the engine operating range as desired. While a bolted-only liner on a medium-sized engine may work if resonant modes in the operating range are not critical, this introduces uncertainty and risk to a design under development. Therefore, fan case liners may be secondarily attached to the fan case, which is conventionally done with bonding.

Fan case liners can be damaged during bird strikes or by foreign objects and it is convenient to be able to replace a few liners instead of having to replace an entire fan case. To maintain a serviceable configuration and one that does not require special heat-cured film adhesive skills and equipment in the supply chain, a room temperature adhesive or sealant such as polysulphide or Hysol EA9394 can be used for this task. However, such sealant or adhesive is not as weight-efficient for a design and results in liners being difficult to remove and replace, thereby negating much of the purpose of replaceable fan case liners. Polysulphide particularly is also a flammable material so a large quantity of the material is a potential concern. It is only useful to change out liners if it can be done quickly and practically. Room temperature bonding operations do not provide for a quick or convenient de-bonding, removal, and replacement. The effort to obtain a clean and properly prepared surface to bond to can be challenging for example.

There is thus a desire to further improve fan case assemblies with fan case liners.

According to an aspect of the invention, a fan case assembly for a gas turbine engine is provided. The fan case assembly comprises a fan case having an inner surface, a fan case liner having an outer surface, and a reclosable fastening system attaching the fan case liner to the fan case, the reclosable fastening system comprising two components, a first component being attached to the fan case inner surface and a second component being attached to the fan case liner outer surface.

Aspects of the invention are thus based on the idea to implement a reclosable fastening system, also referred to hook and loop fastening system (and colloquially referred to as Velcro®), to connect a fan case liner to the fan case, such connection eliminating harmful vibrational modes in the operating range. One benefit associated with aspects of the present invention compared to the use of room temperature adhesive bonding lies in avoiding any substantial re-work to the fan case inner bore, such re-work including removal of old adhesive material and preparing the casing surface for new bonding when using room temperature adhesive. This not only reduces the risk of damaging the fan case but also imposes the requirement for additional fan case thickness for a repair allowance. A serviceable liner is provided for.

Further advantages are associated with such concept. Using a reclosable fastening system allows for a relatively easy assembly. For example, a band featuring loops may be applied to the fan case inner surface after a limited preparation including abrading and cleaning. The supplier for the fan case liners may apply a band featuring hooks to the finished parts. The hook and loop arrangement speeds up assembly time and eliminates messiness and the difficulties of applying a room temperature adhesive. Furthermore, there is no risk of sealant fouling the case hook with adhesives, and the use of a reclosable fastening system allows to re-position a fan case liner if needed.

In an embodiment, the fan case liner is configured to be rotated into position against the fan case. This allows for an easy and efficient assembly of the fan case liner, wherein during rotation the first and second components of the reclosable fastening system come into contact and provide for a fastening connection.

In particular, to rotate the fan case liner against the fan case, it may be provided that the fan case comprises a front hook, the front hook providing the pivot point of the rotation of the fan case liner. Further, the fan case liner comprises a front flange, wherein the front flange is configured to be slid over the front hook. After the fan case liner has been rotated into position, the front hook and the front flange are screwed together. In addition, an aft end of the fan case liner may additionally be attached to the fan case by means of a row of fasteners.

Generally, it may be provided that the fan case liner is additionally attached to the fan case by means of at least one row of fasteners. Embodiments of the connection include fasteners formed by screws, bolts or flange connections.

In a further embodiment, offset pads are provided and arranged between the fan case inner surface and the fan case liner outer surface, wherein the offset pads define the radial distance between the fan case liner and the fan case and set the proper height of the fan case liners. The offset pads may be pre-attached to the fan case liner outer surface by the manufacturer of the fan case liner.

In an embodiment, the reclosable fastening system is axially located at a center or center region between a front end and an aft end of the fan case liner, or may be located forward to the center.

The first component is bonded to the fan case inner surface and the second component is bonded to the fan case liner outer surface, wherein an adhesive is used to connect the first and second components of the reclosable fastening system to the fan case inner surface and the fan case liner outer surface, respectively.

The reclosable fastening system is configured such that the bond between the first component and the fan case inner surface and the bond between the second component and the fan case liner outer surface are each stronger than the peel strength provided by the reclosable fastening system required to peel apart the first component and the second component. This avoids that during disassembly one component is peeled off the fan case liner or the fan case, leaving two interlocked components attached to the fan case liner or the fan case.

The principles of the present invention apply to any fan case liner. In an embodiment, the fan case liner is a fan track liner. A fan track liner comprises an inner layer of abradable material. During operation of the engine, the fan blades rotate freely within the fan track liner. At their maximum extension of movement the blades cut a path into the abradable layer creating a seal against the fan casing and minimizing air leakage around the blade tips.

In another embodiment, the fan case liner is a front acoustic panel or a rear acoustic panel. An acoustic panel provides perforated skins and a honeycomb core for noise treatment. In still another embodiment, the fan case liner may be an ice impact liner located aft the fan track liner.

In embodiments, all liners or a plurality of liners of the fan case are attached to the fan case by means of a reclosable fastening system. In other embodiments, only one of the liners such as the fan track liner is attached to the fan case by means of a reclosable fastening system.

As already mentioned, the reclosable fastening system may be a hook and loop fastening system, wherein one component features hooks and the other component features loops which interact. A wide variety of materials may be used to implement the hook and loop fastening system as is known to the person skilled in the art. Examples include Teflon hooks and/or loops and polyester hooks and/or loops or a metallic hook and loop fastening system such as the one known as Metaklett™.

With a hook and loop fastening system, it may be provided that the first component of the hook and loop fastening system connected to the fan case inner surface is featuring hooks, wherein the second component of the hook and loop fastening system connected to the fan case liner outer surface is featuring loops. However, this is an example only and the implementation may be vice versa.

In an embodiment, the reclosable fastening system is a mushroom head fastening system, wherein mushroom-shaped stems such as mushroom-shaped polyolefin stems snap together to form a high tensile closure. In such embodiment, the first component and the second component are identical. Examples of mushroom head fastening systems are provided by the company 3M and known as 3M™ Dual Lock™.

In an embodiment, the second component is pre-applied to the fan case liner. Accordingly, the supplier for the fan case liners may apply one of the two components to the finished fan case liner, thereby simplifying assembly of the reclosable fastening system. The other component may be applied to the fan case prior to assembly.

In embodiments, the first component and the second component each comprise a linear strip extending in the circumferential direction. In particular, the reclosable fastening system may come in standard widths, including 1". This makes the process of installation much simpler than with a room temperature sealant or adhesive where a wide area need to be prepared and then the room temperature sealant or adhesive is combed on. That is the preparation for the components are much more precise and limited in area (as well as time required) than a room temperature panel bonding operation.

In an embodiment, the linear strip extends over the complete circumferential length of the fan case. Alternatively, the first and second components each comprise several linear strips extending in the circumferential direction, wherein the strips are spaced apart in the circumferential direction. Accordingly, a continuous or interrupted linear strip may be implemented.

Further, it may be provided that the first and second component each comprise several linear strips spaced apart in the axial direction. Accordingly, dependent on the axial length of the fan case liner and the resonant modes of the fan that need to be considered, one or several linear strips may be implemented spaced apart in the axial direction, each strip extending in the circumferential direction.

It is pointed out that the fan case liner may be formed by panels extending less than 360° in the circumferential direction, wherein the panels have the same axial extension and are arranged next to each other in the circumferential direction.

As discussed, aspects of the present invention are associated with the advantage that the hook and loop fastening system allows for an easy disassembly of a fan case liner in case it has been damaged. To this end, in an embodiment, a threaded insert is integrated into or connected to the outer surface of the fan case liner, wherein the threaded insert is configured to receive a tool reacting against the fan case and pushing the fan case liner away from the fan case, thereby separating the two components of the reclosable fastening system. Alternatively, a wedge may be applied to the edges of the fan case liner to initiate peeling off.

In a further aspect of the invention a gas turbine engine for an aircraft is provided which comprises:

- an engine core comprising a turbine, a compressor, and a core shaft connecting the turbine to the compressor;
- a fan located upstream of the engine core, the fan comprising a plurality of fan blades;
- a planetary gearbox that receives an input from the core shaft and outputs drive to the fan so as to drive the fan at a lower rotational speed than the core shaft; and
- a fan case assembly as disclosed herein, wherein the fan is enclosed by the fan case assembly.

In an embodiment, it is provided that

- the turbine is a first turbine, the compressor is a first compressor, and the core shaft is a first core shaft;
- the engine core further comprises a second turbine, a second compressor, and a second core shaft connecting the second turbine to the second compressor; and
- the second turbine, second compressor, and second core shaft are arranged to rotate at a higher rotational speed than the first core shaft.

It should be noted that the present invention is described in terms of a cylindrical coordinate system having the coordinates x, r and φ. Here x indicates the axial direction, r the radial direction and φ the angle in the circumferential direction. The axial direction is defined by the machine axis of the gas turbine engine in which the present invention is implemented, with the axial direction pointing from the engine inlet to the engine outlet. Starting from the x-axis, the radial direction points radially outwards. Terms such as "in front of", "forward", "behind", "rearward" and "aft" refer to the axial direction or flow direction in the engine. Terms such as "outer" or "inner" refer to the radial direction.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds). These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge. The fan diameter (which may simply be twice the radius of the fan) may be greater than (or on the order of) any of: 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm or 390 cm (around 155 inches). The fan diameter may be in an inclusive range bounded by any two of the values in the previous sentence (i.e. the values may form upper or lower bounds).

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 250 cm to 300 cm (for example 250 cm to 280 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 320 cm to 380 cm may be in the range of from 1200 rpm to 2000 rpm, for example in the range of from 1300 rpm to 1800 rpm, for example in the range of from 1400 rpm to 1600 rpm.

In use of the gas turbine engine, the fan (with associated fan blades) rotates about a rotational axis. This rotation results in the tip of the fan blade moving with a velocity Utip. The work done by the fan blades 13 on the flow results in an enthalpy rise dH of the flow. A fan tip loading may be defined as dH/Utip2, where dH is the enthalpy rise (for example the 1-D average enthalpy rise) across the fan and Utip is the (translational) velocity of the fan tip, for example at the leading edge of the tip (which may be defined as fan tip radius at leading edge multiplied by angular speed). The fan tip loading at cruise conditions may be greater than (or on the order of) any of: 0.3, 0.31, 0.32, 0.33, 0.34, 0.35, 0.36, 0.37, 0.38, 0.39 or 0.4 (all units in this paragraph being Jkg−1 K−1/(ms−1)2). The fan tip loading may be in an inclusive range bounded by any two of the values in the previous sentence (i.e. the values may form upper or lower bounds).

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, or 17. The bypass ratio may be in an inclusive range bounded by any two of the values in the previous sentence (i.e. the values may form upper or lower bounds). The bypass duct may be substantially annular. The bypass duct may be radially outside the core engine. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds).

Specific thrust of an engine may be defined as the net thrust of the engine divided by the total mass flow through the engine. At cruise conditions, the specific thrust of an engine described and/or claimed herein may be less than (or on the order of) any of the following: 110 Nkg−1s, 105 Nkg−1s, 100 Nkg−1s, 95 Nkg−1s, 90 Nkg−1s, 85 Nkg−1s or 80 Nkg−1s. The specific thrust may be in an inclusive range bounded by any two of the values in the previous sentence (i.e. the values may form upper or lower bounds). Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). The thrust referred to above may be the maximum net thrust at standard atmospheric conditions at sea level plus 15 deg C. (ambient pressure 101.3 kPa, temperature 30 deg C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds). The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example, at least a part of the fan blade and/or aerofoil may be manufactured at least in part from a composite, for example a metal matrix composite and/or an organic matrix composite, such as carbon fiber. By way of further example at least a part of the fan blade and/or aerofoil may be manufactured at least in part from a metal, such as a titanium based metal or an aluminum based material (such as an aluminum-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fiber or aluminum based body (such as an aluminum lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades maybe formed integrally with a central portion. Such an arrangement may be referred to as a blisk or a bling. Any suitable method may be used to manufacture such a blisk or bling. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 16, 18, 20, or 22 fan blades.

As used herein, cruise conditions may mean cruise conditions of an aircraft to which the gas turbine engine is attached. Such cruise conditions may be conventionally defined as the conditions at mid-cruise, for example the conditions experienced by the aircraft and/or engine at the midpoint (in terms of time and/or distance) between top of climb and start of decent.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be the cruise condition. For some aircraft, the cruise conditions may be outside these ranges, for example below Mach 0.7 or above Mach 0.9.

Purely by way of example, the cruise conditions may correspond to standard atmospheric conditions at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to: a forward Mach number of 0.8; a pressure of 23000 Pa; and a temperature of −55 deg C.

As used anywhere herein, "cruise" or "cruise conditions" may mean the aerodynamic design point. Such an aerodynamic design point (or ADP) may correspond to the conditions (comprising, for example, one or more of the Mach Number, environmental conditions and thrust requirement) for which the fan is designed to operate. This may mean, for example, the conditions at which the fan (or gas turbine engine) is designed to have optimum efficiency.

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

The invention will be explained in more detail on the basis of exemplary embodiments with reference to the accompanying drawings in which:

FIG. 5 is an embodiment of a fan case assembly comprising a fan case and a fan case liner, wherein components of a reclosable fastening system are attached to a fan case inner surface and a fan case liner outer surface, wherein FIG. 5 depicts a moment of assembly in which the fan case liner is rotated into contact with the fan case;

Figure 9:
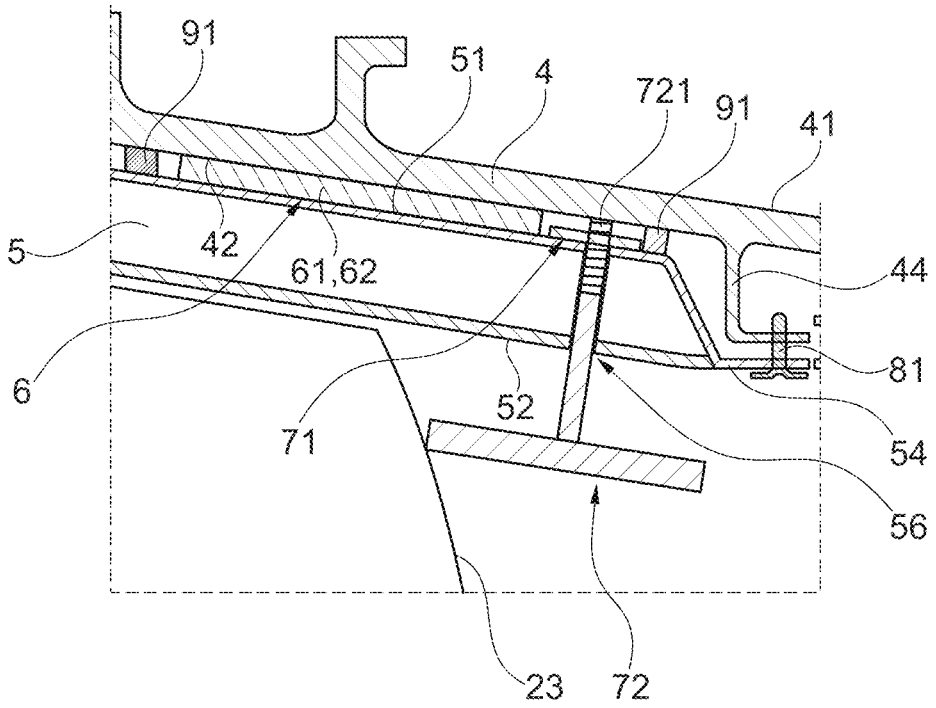
FIG. 9 is a detail of a fan case assembly comprising a fan case and a fan case liner connected by means of a reclosable fastening system, wherein a threaded insert is incorporated into the fan track liner to assist removal of the fan track liner by means of a tool.
Figure 9A:
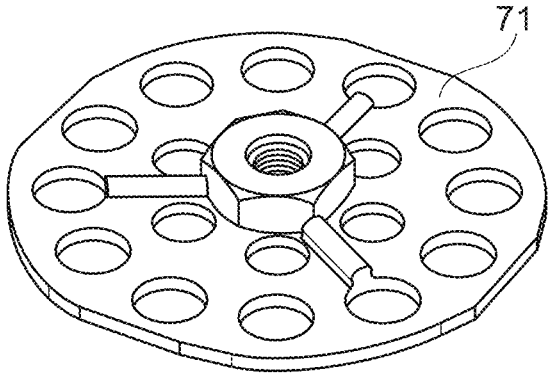
Figure 10:
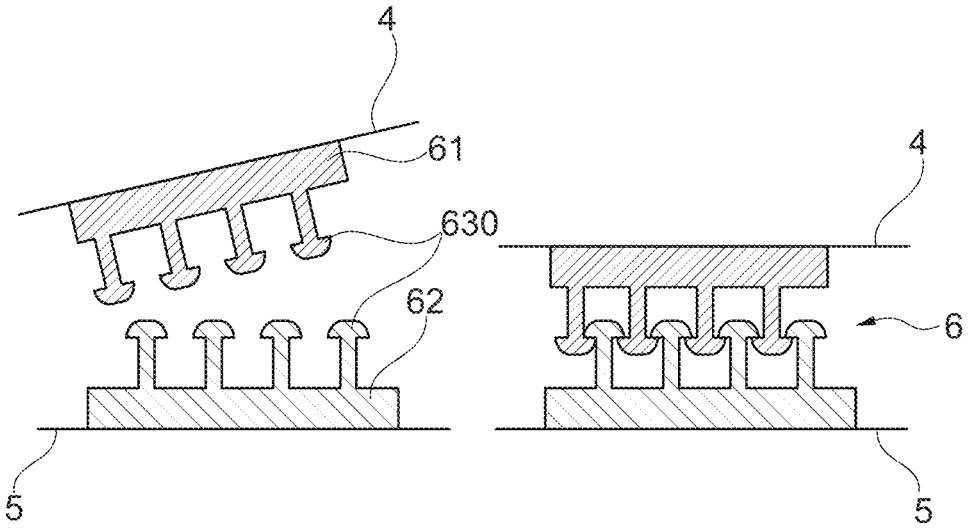

FIG. 9*a* shows an embodiment of the threaded insert of the fan case assembly of FIG. 9; and FIG. 10 is an embodiment of a reclosable fastening system implemented as a mushroom head fastening system.

Figure 1:
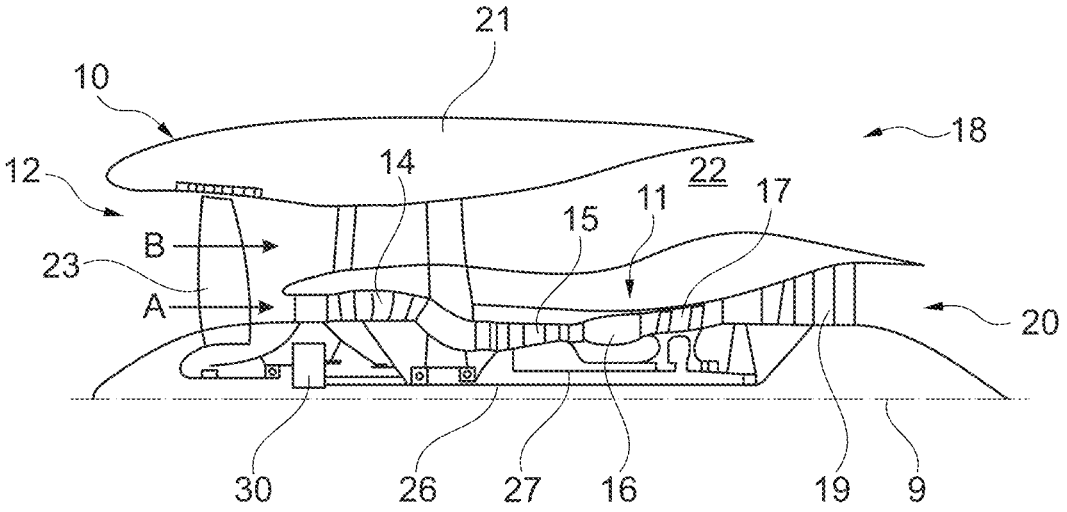
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclical gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclical gearbox 30 is a reduction gearbox.

Figure 2:
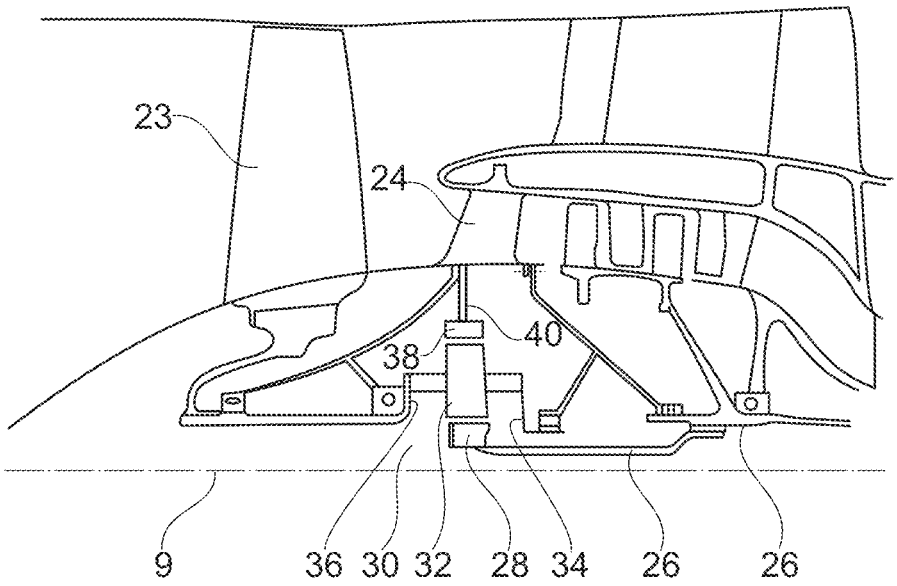
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclical gear arrangement 30. Radially outwardly of the sun gear 28 and intermeshing therewith is a plurality of planet gears 32 that are coupled together by a planet carrier 34. The planet carrier 34 constrains the planet gears 32 to process around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
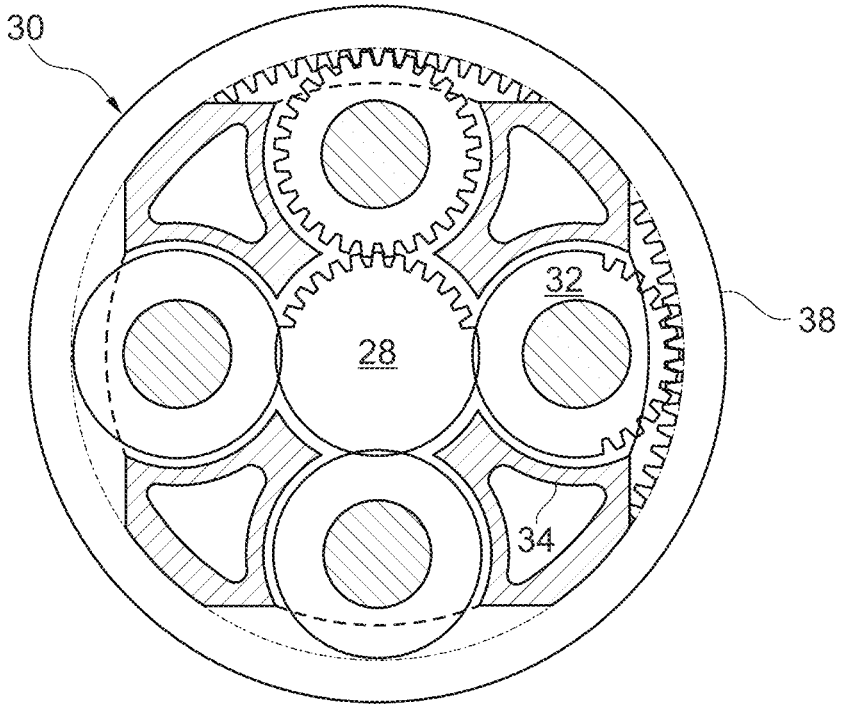
FIG. 3 is a partially cut-away view of a gearbox for a gas turbine engine.

The epicyclical gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclical gearbox 30 generally comprise at least three planet gears 32.

The epicyclical gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclical gearbox 30 may be used. By way of further example, the epicyclical gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 20, 22 meaning that the flow through the bypass duct 22 has its own nozzle that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

In the context of the present invention, the design of a fan case assembly enclosing a fan is of relevance. It is pointed out that the fan case assembly that will be discussed in the following may be implemented in a geared turbofan engine as discussed with respect to FIGS. 1 to 3 but may generally be implemented in any gas turbine engine. The principles of the present invention are not dependent on a particular kind of gas turbine engine.

More particularly, a particularly useful application lies with Civil Small and Medium Engines, which may have a fan diameter in the range between 35 to 55". The rotational speed of the fan of such Civil Small and Medium Engines may be in the range between 5000 and 9000 rpm at Maximum Takeoff Thrust.

Figure 4:
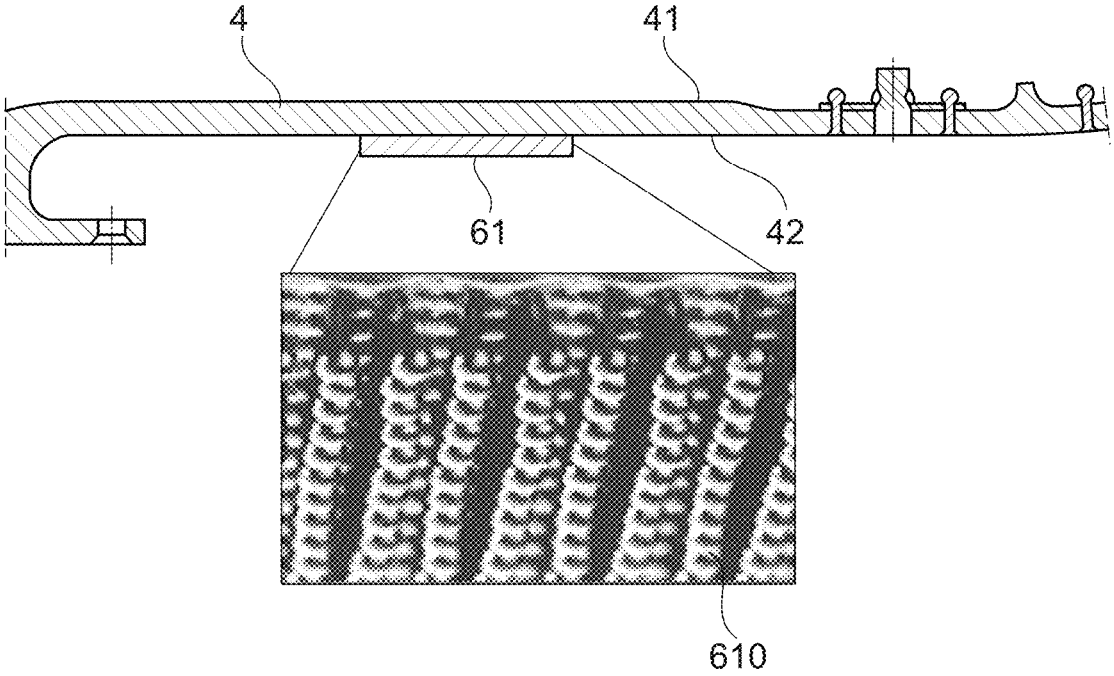
FIG. 4 is an embodiment of a fan case to which a reclosable fastening system component is attached.

FIG. 4 depicts a fan case 4 circumferentially surrounding a fan (not shown). The fan case 4 may be any fan case implemented in a turbofan engine. It comprises a front end at which it is connected to an engine inlet and an aft end at which it is connected to further structural elements of the gas turbine engine. The fan case 4 comprises an outer surface 41 and an inner surface of 42, wherein the inner surface 42 faces the flow path through the fan. Several liners or panels may be arranged along the inner surface 42, wherein FIG. 4 depicts an area of the fan case 4 which is suitable and configured for attachment of a fan track liner. Further fan case liners such as a front acoustic panel, an ice impact liner and a rear acoustic panel may be connected to the fan case 4 in other axial sections.

As will be discussed in more detail with respect to FIG. 5, a reclosable fastening system or hook and loop fastening system is implemented to connect a fan track liner to the fan case. A hook and loop fastening system comprises a first component and a second component which interact as is known to the skilled person. The components are typically provided in the form of linear strips, but may in principle have other forms as well.

In FIG. 4, a first component 61 of hook and loop fastening system is connected to the fan case inner surface 42. The connection is by bonding using an appropriate adhesive. As is schematically depicted in FIG. 4, the first component 61 is featuring hooks 610 but may instead feature loops.

Figure 5:
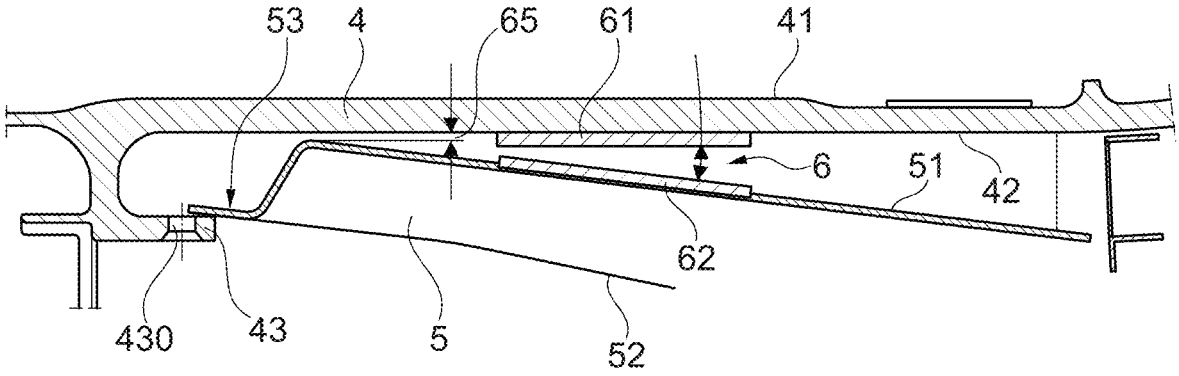

FIG. 5 shows an embodiment of a fan case assembly, wherein the fan case assembly is depicted in a moment during assembly. The fan case assembly comprises a fan case 4 similar to the fan case of FIG. 4. The fan case assembly further comprises a fan track liner 5 having an outer surface 51 and inner surface 52. The outer surface 51 of the fan track liner 5 may be formed by an outer tray. Generally, a fan track liner is structurally embodied in such a manner that it is suited for receiving fan fragments in the event that a fan blade breaks and for avoiding that they penetrate the engine nacelle in an outward direction. For example, it may comprise a honeycomb core structure which is covered by a composite septum sheet. Further, attached to the inner surface 52 is a layer of abradable material (not shown) in a manner known to the skilled person. Such layer of abradable material minimizes air leakage around the blade tips of the fan. However, in the context of the present invention the exact buildup of the fan track liner is not of relevance and any suitable construction and materials may be implemented.

The fan case liner 5 is connected to the fan case 4 by means of a hook and loop fastening system 6. The hook and loop fastening system 6 comprises a first component 61 featuring hooks connected to the inner surface 41 of the fan case 4. The hook and loop fastening system 6 further comprises a second component 62 featuring loops connected to the outer surface 51 of the fan track liner 5. Upon touch, the first and second components 61, 62 provide for a connection which is very strong to withstand pulling forces and shear forces and weaker to withstand pealing forces, the latter allowing for an easy disassembly as will be discussed further below.

For assembly, the fan case liner 5 is rotated against the fan case 4. To this end, the fan case 4 comprises a front hook 43. The front end of the fan track liner 5 comprises a front flange 53. The front flange 53 is slid over the front hook 43, wherein screw holes in the front flange 53 (not shown) and screw holes 430 in the front hook 43 come into alignment. After rotation, the front flange 53 and the front hook 43 are screwed together by means of a nutplate (not shown).

Further, the fan case liner 5 may be attached to the fan case 4 at the aft end of the fan case liner 5 by means of a row of fasteners such as bolts (not explicitly shown in FIG. 4 but shown and discussed in the embodiment of FIG. 9), thereby eliminating the need for hook and loop between bolt holes to avoid mode in the operating range. This ensures that there is only an axially limited circumferential zone for the reclosable fastening system and improves the leverage to peel the fan case liner 5 out once the aft bolts are removed.

During rotation, the first component 61 of the fan case 4 and the second component 62 of the fan track liner 5 come into contact and create a firm connection between the fan track liner 5 and the fan case 4. If necessary, a thin sheet of plastic could be placed between the two components 61, 62 during installation. The sheet would prevent the fan case liner 5 from being attached while the fan case liner 5 is placed in proper position. Once the fan case liner 5 is aligned, the sheet is removed and the fan case liner 5 is pressed into place.

The hook and loop fastening connection comprises a defined radial height 65 which participates in setting the proper height of the fan case liner 5. In addition, offset pads may be provided for proper height setting as will be discussed with respect to FIG. 9.

The hook and loop fastening system can be implemented based on a wide variety of materials, such as polyester and Teflon. Also, a metallic hook and loop fastening system may be implemented.

The hook and loop fastening system 6 may be implemented such that the first component 61 comprises hooks 610 as shown in FIG. 4 and the second component 62, accordingly, comprises loops, or vice versa. However, other reclosable fastening systems may be implemented alternatively. FIG. 10 shows an alternative embodiment in which a mushroom head fastening system 6 is implemented comprising identical first and second components 61, 62 each comprising mushroom heads 630. Such mushroom head fastening systems are provided by the company 3M and known as 3M™ Dual Lock™.

The first and second components 61, 62 may be arranged in the axial direction roughly central (midspan) between the front end and the aft end of the fan case liner 5 (which corresponds to the axial distance between the screw holes 430 and a rear row of bolting). In embodiments, they may be located forward to such central position.

Figure 6:
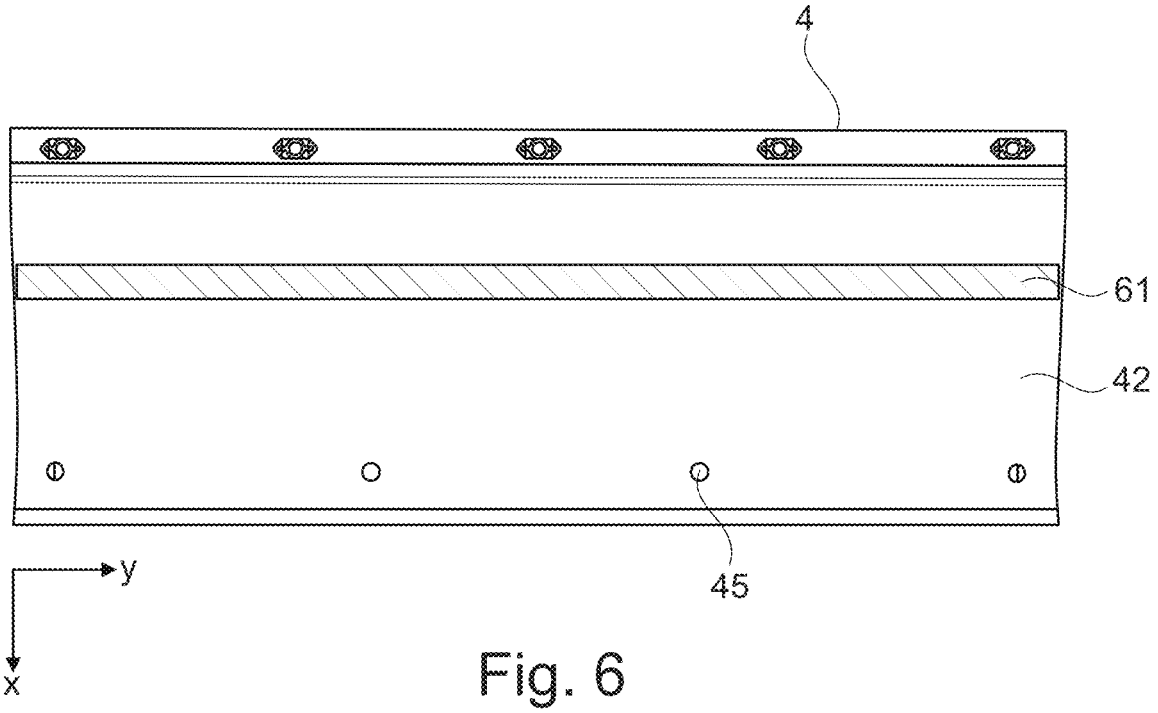
FIG. 6 is a view radially outward onto a fan case inner surface, wherein a linear strip of a reclosable fastening system is bonded to the fan case inner surface and extends in the circumferential direction.
Figure 7:
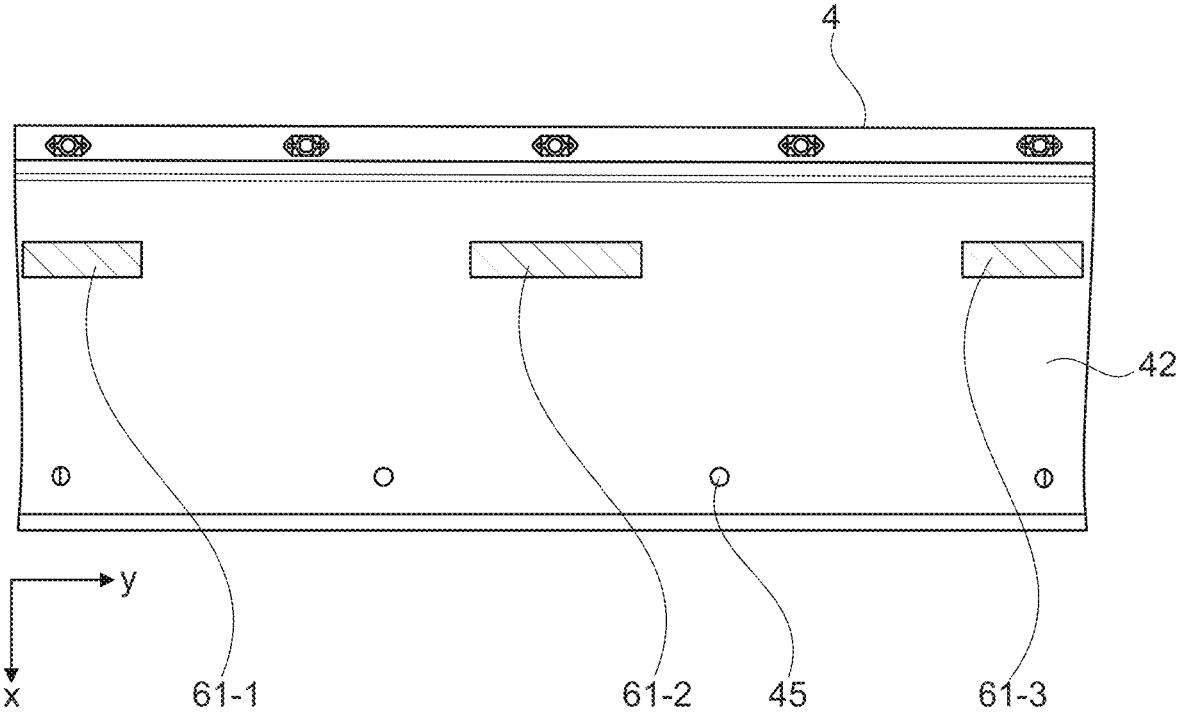
FIG. 7 is a view radially outward onto a fan case inner surface, wherein several spaced apart linear strips of a reclosable fastening system are bonded to the fan case inner surface, each extending in the circumferential direction.

FIGS. 6 and 7 show two embodiments of the manner in which the first component 61 extends in the circumferential direction along the inner surface 41 of the fan case 4. Both figures hook radially outside onto the inner surface 42 of the fan case 4. The axial direction corresponds to the vertical extension of FIGS. 6 and 7 and the circumferential direction corresponds to the horizontal extension of FIGS. 6 and 7.

According to FIG. 6, the first component 61 is a linear strip extending in the circumferential direction over the complete circumferential length of the fan case (thus 360°). The linear strip may be an inch wide band. According to FIG. 7, the first component 61 comprises a plurality of linear strips 61-1 to 61-3 each extending in the circumferential direction, wherein the individual strips are spaced apart in the circumferential direction. Accordingly, a continuous or interrupted connection between the fan track liner 5 and the fan case for may be provided for in the circumferential direction.

Naturally, the second component 62 extends in the same manner and with the same length as the first component 61 on the outer surface of the fan case liner and, accordingly, also comprises continuous or interrupted linear strips extending in the circumferential direction.

FIGS. 6 and 7 also show bolt holes 45 in the fan case used for bolting the aft end of the fan track liner to the fan case 4.

Figure 8:
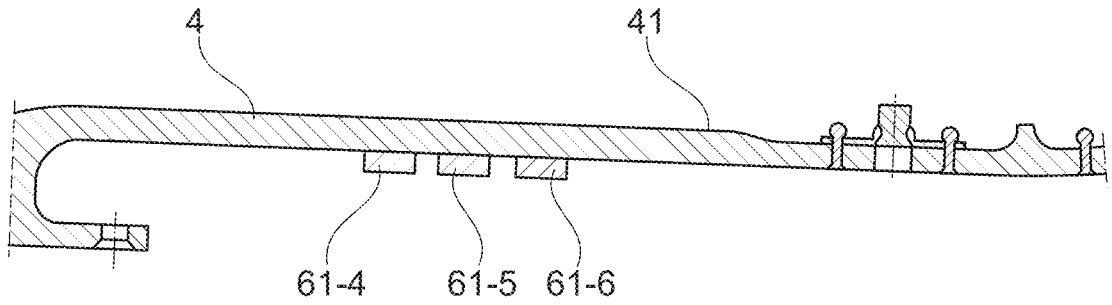
FIG. 8 is an embodiment of a fan case to which a plurality of axially spaced linear strips are attached.

FIG. 8 shows an embodiment of the fan case 4, wherein the first component 61 comprises a plurality of linear strips 61-4, 61-5, 61-6 which are spaced apart in the axial direction. This allows to attach the fan track liner to the fan case 4 at a plurality of axial positions. The circumferential extension of the linear strips 61-4, 61-5, 61-6 may be in accordance with FIG. 6 or FIG. 7. Further, the second component 62 of the hook and loop fastening system extends in the same manner and with the same length on the outer surface of the fan case liner and, accordingly, also comprises a plurality of linear strips spaced apart in the axial direction.

FIG. 9 is an enlarged view of the aft end of a connection between a fan case liner 5 and a fan case 4 by means of a hook and loop fastening system and may represent an example of the aft end connection of the embodiment of FIG. 5. FIG. 9 further comprises details of how to disassemble the hook and loop fastening system.

More particularly, FIG. 9 depicts the aft end of a fan track liner 5 connected by means of a hook and loop fastening system 6 to a fan case 4 in the manner described before. More particularly, a first component 61 connected to the fan case 4 and a second component to connected to the fan case liner 5 are in reclosable and provide for a hook and loop connection.

FIG. 9 further shows that the fan track liner 5 forms at its aft end an aft flange 54 which is connected by means of a row of bolts 81 to a structure 44 of the fan case 4.

Further, the embodiment of FIG. 9 depicts offset pads 91 with closely controlled thickness which are arranged between the outer surface 51 of the fan track liner 5 and the inner surface 42 of the fan case 4. Such offset pads 91 may be pre-attached to the outer surface 51 of the fan case liner 5 by the manufacturer of the fan case liner. They may also be integral into the fan case liner's outer laminate. They serve to exactly define the radial distance between the fan case liner 5 and the fan case 4 and to set the proper radial height of the fan case liner 4. Controlling the radial location of the fan case liner 5 is critical to ensure that the rotor tip clearance is maintained throughout operation. Ensuring a gap between the liner and the case may also allow for threaded device 71 be inserted during disassembly instead of being integral into liner 5.

FIG. 9 also depicts a blade tip of a fan 23.

Generally, the hook and loop fastening system 6 may be configured such that the bond between the first component 61 and the fan case inner surface 42 and the bond between the second component 62 and the fan case liner outer surface 51 are each stronger than the peel strength provided by the reclosable fastening system 6 required to peel apart the first component 61 and the second component 62. This allows to conveniently disassemble the fan track liner 5 if damaged and replace it.

For disassembly, the screws and bolts are removed first. Subsequently, in an embodiment, a wedge of metal or plastic is inserted on the edges of the fan track liner 5 between the liner and casing hook and loop to begin peeling the outer tray of the fan case liner 5 off the casing skin.

In another embodiment, which is depicted in FIG. 9, a threaded insert 71 is integrated into the fan track liner 5 or temporarily held to the outside surface 51 of the fan track liner 5. FIG. 9*a* shows an embodiment of such threaded insert 71. Further, access holes 56 are included through the liner inner diameter at each insert location. A tool 72 such as a T-handle tool can be inserted through the access holes 56 and threaded into the threaded insert 71. The tool 72 reacts against the fan case 4 as it is advanced into the threads of insert 71 thus pushing the hook and loop apart. The insert 71 is installed around the periphery of the fan track liner 5 to start peeling the hook and loop apart. The tool 72 can include a plastic tip 721 to avoid marring the fan case 4.

Accordingly, by threading the tool 72 into the threaded insert 71, the fan case liner 5 is pushed away from the fan case 4 and the components 61, 62 are peeled out of contact. As hook and loop connections are strong in pulling or shear but weaker in peel, such motion is best suited to separate the components 61, 62. However, in normal operation the fan case liner 5 could not be peeled off the fan case 4 as the aft bolts 81 are resisting motion of the fan case liner in the direction of prying.

While the detailed description referred to the attachment of a fan track liner to a fan case by means of a reclosable fastening system, this is to be understood as exemplary only. A similar attachment may be provided between other fan case liners and a fan case.

It should be understood that the above description is intended for illustrative purposes only and is not intended to limit the scope of the present disclosure in any way. For example, the above description refers to the attachment of a fan track liner to a fan case by means of a reclosable fastening system. A similar attachment may be provided between other fan case liners and a fan case.

Also, those skilled in the art will appreciate that other aspects of the disclosure can be obtained from a study of the drawings, the disclosure and the appended claims. All methods described herein can be performed in any suitable order unless otherwise indicated herein or otherwise clearly contradicted by context. Various features of the various embodiments disclosed herein can be combined in different combinations to create new embodiments within the scope of the present disclosure. In particular, the disclosure extends to and includes all combinations and sub-combinations of one or more features described herein. Any ranges given herein include any and all specific values within the range and any and all sub-ranges within the given range.

The invention claimed is:

1. A fan case assembly for a gas turbine engine, the fan case assembly comprising:

a fan case having an inner surface;

a fan case liner having an outer surface; and a reclosable fastening system attaching the fan case liner to the fan case, the reclosable fastening system comprising first and second components, the first component being attached to the fan case inner surface and the second component being attached to the fan case liner outer surface;

a threaded insert integrated into or connected to the outer surface of the fan case liner, the threaded insert being configured to receive a tool reacting against the fan case and pushing the fan case liner away from the fan case, thereby separating the first and second components of the reclosable fastening system.

2. The fan case assembly of claim 1, wherein the fan case liner is configured to be rotated into position against the fan case.

3. The fan case assembly of claim 2, and further comprising:

a front hook of the fan case, the front hook providing a pivot point of the rotation of the fan case liner, and a front flange of the fan case liner, wherein the front flange is configured to be slid over the front hook, and wherein the front hook and the front flange are screwed together after the fan case liner has been rotated into position.

4. The fan case assembly of claim 3, wherein an aft end of the fan case liner is additionally attached to the fan case by a row of fasteners.

5. The fan case assembly of claim 1, wherein the fan case liner is additionally attached to the fan case of at least one row of fasteners.

6. The fan case assembly of claim 1, and further comprising offset pads arranged between the fan case inner surface and the fan case liner outer surface, the offset pads defining a radial distance between the fan case liner and the fan case and setting a radial height of the fan case liner.

7. The fan case assembly of claim 1, wherein the reclosable fastening system is axially located at a center or center region between a front end and an aft end of the fan case liner, or forward of the center.

8. The fan case assembly of claim 1, wherein the first component is bonded to the fan case inner surface and the second component is bonded to the fan case liner outer surface.

9. The fan case assembly of claim 8, wherein the reclosable fastening system is configured such that the bond between the first component and the fan case inner surface and the bond between the second component and the fan case liner outer surface are each stronger than a peel strength provided by the reclosable fastening system required to peel apart the first component and the second component.

10. The fan case assembly of claim 1, wherein the fan case liner is a fan track liner.

11. The fan case assembly of claim 1, wherein the fan case liner is a front acoustic panel or a rear acoustic panel.

12. The fan case assembly of claim 1, wherein the reclosable fastening system is a hook and loop fastening system.

13. The fan case assembly of claim 12, wherein the first component of the hook and loop fastening system attached to the fan case inner surface includes hooks.

14. The fan case assembly of claim 1, wherein the reclosable fastening system is a mushroom head fastening system.

15. The fan case assembly of claim 1, wherein the second component is preapplied to the fan case liner.

16. The fan case assembly of claim 1, wherein the first component and the second component each comprise a linear strip extending in a circumferential direction.

17. The fan case assembly of claim 16, wherein each linear strip extends over a complete circumferential length of the fan case.

18. The fan case assembly of claim 16, wherein the first and second components each comprise several linear strips extending in the circumferential direction, wherein the strips are spaced apart in the circumferential direction.

19. The fan case assembly of claim 16, wherein the first and second component each comprise several linear strips spaced apart in an axial direction.

* * * * *